United States Patent [19]

Gertz

[11] 3,943,310

[45] Mar. 9, 1976

[54] MALE CONNECTOR PLUG WITH IMPROVED SWITCH MECHANISM

[76] Inventor: Albert E. Gertz, 9232 Alcona St., Lanham, Md. 20801

[22] Filed: Oct. 18, 1974

[21] Appl. No.: 515,968

[52] U.S. Cl. ..... 200/51 R; 200/51.12

[51] Int. Cl.[2] ..... H01R 13/70

[58] Field of Search ... 200/51 R, 298, 153 M, 51.12

[56] References Cited

UNITED STATES PATENTS

| | | | |
|---|---|---|---|
| 1,912,252 | 5/1933 | Brown | 200/51 R |
| 3,027,434 | 3/1962 | Palermo | 200/51 R |

FOREIGN PATENTS OR APPLICATIONS

| | | | |
|---|---|---|---|
| 179,313 | 5/1922 | United Kingdom | 200/51 R |
| 629,056 | 9/1949 | United Kingdom | 200/51 R |

*Primary Examiner*—David Smith, Jr.

*Attorney, Agent, or Firm*—Sughrue, Rothwell, Mion & Zinn

[57] ABSTRACT

A two part cylindrical insulation body for a male electrical plug is provided with a recess at the abutting end face and a two section prong has sections carried by respective body portions with flexible switch contact within the recess and facing each other. A rotatable sleeve mounted on the body in concentric fashion for rotation is provided with an integral sector-shaped projection on its inner periphery which may be rotated to place an insulative portion between the flexible contact or a conductive insert to complete an electrical circuit between the prong sections.

3 Claims, 4 Drawing Figures

FIG. 1
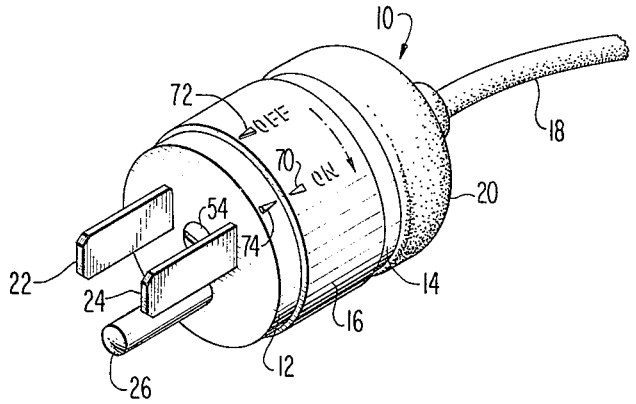
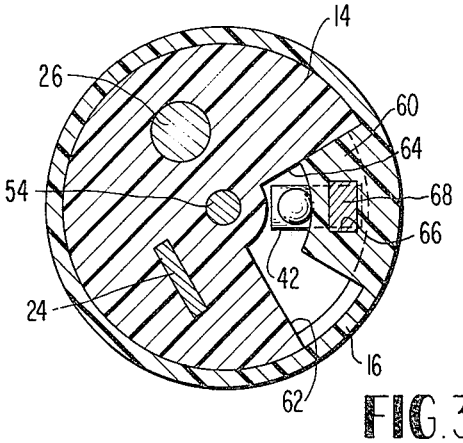
FIG. 3
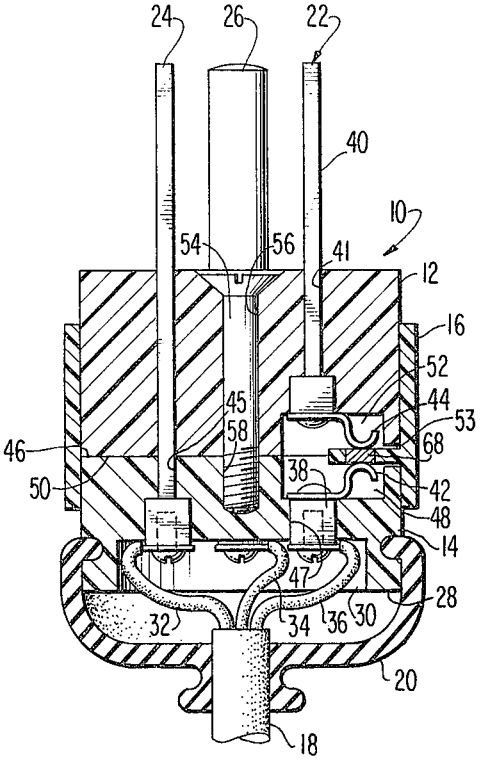
FIG. 2
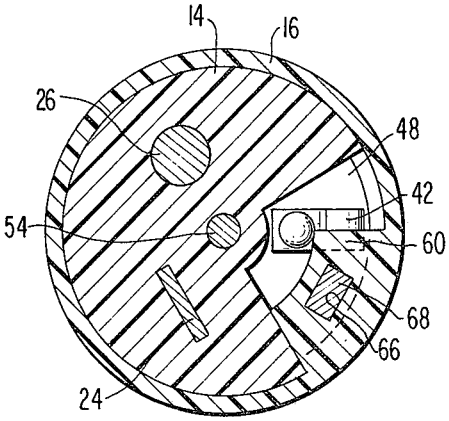
FIG. 4

MALE CONNECTOR PLUG WITH IMPROVED SWITCH MECHANISM

BACKGROUND OF THE INVENTION

1. Field of the Invention

This invention relates to male electrical connector plugs such as conventional wall plugs and more particularly to such plugs which incorporate a switch mechanism for disconnecting the circuit from the lead wires of the plug to one or more of the male prongs carried thereby.

2. Description of the Prior Art

The incorporation of a switch mechanism into a male or female electrical connector plug is well known to the connector industry. Patents representative of such combination are as follows:

| | | |
|---|---|---|
| 1,728,549 | Huppert | Sept. 17, 1929 |
| 1,912,252 | Brown | May 30, 1933 |
| 2,233,257 | Grohsgal | Feb. 25, 1941 |
| 2,480,787 | Stephan | Aug. 30, 1949 |

Such structures have been complicated in terms of construction, have been expensive to manufacture and have been unreliable in operation.

Therefore, a primary object of the present invention is to provide an electrical connector plug with a simple, easily operated switch mechanism for selectively completing an electrical circuit to one or more of the prong members of such plug and one wherein the switching from circuit on to off condition or vice versa may be easily achieved, and wherein the switch mechanism is reliable in operation.

SUMMARY OF THE INVENTION

The invention is illustrated in conjunction with a male electrical plug, but may be applicable to a female connector plug. The connector plug includes an insulative body supporting a plurality of spaced, electrically insulated male conductor prongs projecting outwardly of one end of the body and having wires connected to respective prongs. The improvement resides in providing at least one of the prongs in terms of first and second axially spaced, aligned sections within the insulative body and the provision of an insertable plate of insulative material positioned within the body and selectively movable between two positions, one of which is such that the plate insures completion of the electrical circuit between the prong sections and the other in which a portion of the insulative material of the plate is interposed between the prong sections.

Preferably, the body comprises a two part cylindrical assembly and includes a sleeve concentrically positioned on the body and rotatable about a common axis and the plate of insulative material comprises an integral portion of the sleeve which extends radially inwardly of the inner periphery of the sleeve, within a radial slot within the insulative body such that the plate is interposed between the prong sections. The body may compose abutting cylinders of insulative material with a recess provided in the abutting end of at least one of the cylinders, and wherein the prong sections extend through the body in alignment with the recess, respective prong sections terminate within the recess in flexible contacts which oppose each other and wherein the plate is interposed between the flexible contacts to maintain their separation. The plate may incorporate a conductive portion, which when interposed between the contacts, complete the circuit therebetween. Alternatively, the plate may be provided with an aperture such that when the aperture is rotated to a position aligned with the contacts, the flexible contacts flex into contact with each other through the aperture.

BRIEF DESCRIPTION OF THE DRAWINGS

FIG. 1 is a perspective view of the improved male connector plug incorporating the improved switch mechanism of the present invention.

FIG. 2 is a longitudinal sectional view of the embodiment of the invention of FIG. 1.

FIG. 3 is a transverse sectional view of the connector plug of FIG. 2, with the switch in circuit completed position corresponding to FIG. 2.

FIG. 4 is a sectional view of the plug of FIG. 2 similar to that of FIG. 3, but with the switch in circuit interrupted position.

DESCRIPTION OF THE PREFERRED EMBODIMENT

Reference to FIG. 1 illustrates a preferred embodiment of the present invention and discloses an electrical connector plug 10 which in this case constitutes a male plug, that is, it is provided with male terminals or prongs. The plug consists essentially of a pair of cylindrical, body portions 12 and 14 which are in abutment, and support in concentric fashion about their joint peripheries, a rotatable sleeve 16 also formed of insulative material. The electrical cord 18 carries a plurality of wires for connection to the terminals or prongs of the plug connector, the cord 18 being mechanically coupled to cylindrical body portion 14 by way of an insulative cap 20 formed of rubber or the like. From the opposite end of the insulative two part body, there projects the hot line prong indicated generally at 22, the return prong 24, and the ground prong as at 26, the connector being of the polarized type. The prong 24 extends completely through both body sections 12 and 14 and is appropriately connected to one of the lead wires as at 32 by a screw in the conventional manner. Likewise, the ground connection prong 26 extends through both body sections 12 and 14 and is electrically connected to lead wire 34. The third wire 36 is connected to the hot line plug 22, which in this case comprises two sections, a section 38 within body section 14 of the plug and a section 40 within body section 16 of the insulative plug. It is the electrical connection between the prong sections 38 and 40 which forms the inventive aspect of the present invention. While the invention is illustrated in terms of a switch mechanism employable in conjunction with prong 22, but not prong 24, it should be realized that the connection to the return line may be likewise formed by a switch mechanism similar to that employed in connection with the prong 22. The end face 28 of insulative body section 14 is recessed as at 30 to house the connections to the various prongs. Further, the opposite end face 46 of the insulative body section 14 is locally recessed as at 48 in arcuate form with the opposed end face 50 of insulative body section 12 being similarly recessed as at 52. The recesses further extend radially outward to form an arcuate slot 53 conforming generally to the circumferential extent of the paired recesses 52 and 48. Further, to the opposite end of prong section 38 from lead wire 36, there is fixed a flexible contact 42 which is positioned within recess 48. In like fashion, a flexible contact 44 is fixed to the end of prong section 40, such that it occupies recess 52 and the contacts are so configured and are formed of spring metal such that in their relaxed state, in the absence of an interposed member, these contacts physically contact each other to complete an electrical circuit therebetween.

Preferably, sleeve member 16 which is formed of insulative material includes an integral, arcuate projection in the form of plate 60 which is of a thickness slightly less than the width of slot 53 and projects through the slot with the sleeve being maintained axially when the two body sections 12 and 14 are joined together. Body section 12 is provided with a bore 56 which receives a threaded screw 54 which is threadably received within a threaded hole 58 within body section 14 in axial alignment with bore 56 of body section 12. It may be seen therefore that the assembly of the male plug with switch mechanism of the present invention is quite simple and achieved in a systematic, step by step process. For instance, the prong section 40 may be inserted within an appropriate slot 41 of the body section 12, placing flexible contact 44 within recess portion 52 of that body section as a preliminary assembly step.

Further, prong 24 may be inserted within opening 40 of body section 14, and at the same time prong section 26 and prong section 38 mounted to the same body in similar fashion. Section 38 may be inserted within hole 47 from either side of body section 14 as desired, it being necessary only that the flexible contact 42 be fixed to prong section 38 and fit within recess 48 of body section 14. The insulative body sections 12 and 14 may be placed then in abutting position regardless of making the wire connections for wires 32, 34 and 36, the screw 54 may then be threaded to section 14 to couple sections 12 and 14 together with sleeve 16 in place and the arcuate plate 60 projecting within slot 50 and interposed between the flexible contacts 44 and 42 separating the same. As evidenced in FIG. 2, if the rectangular metal insert 68 which fills a rectangular recess 66 corresponding thereto within plate 60 is interposed, as shown in FIG. 2, between the contacts, the circuit is completed between prong sections 38 and 40. If, however, the sleeve 16 is rotated to the position shown in FIG. 4, metal insert 68 is no longer interposed between the contacts, but a portion of the insulative plate 60 is, which maintains the circuit open with respect to prong 22. Alternatively, rather than employing the metal insert 68, the opening 66 could be left as is, assuming that the flexibility of the contacts 42 and 44 are sufficient to insure that these members meet, that is, make mechanical contact within the opening or aperture 68. It may be seen, that the side walls 62 and 64 of the arcuate recesses 48 and 52 are such that the arcuate plate 60 is limited in the extent of its rotative movement about the axis of the assembly as defined by screw 54. The extent of that movement is shown in FIG. 1, wherein when taken in conjunction with FIGS. 3 and 4, rotation of sleeve 16 to the extent that there is alignment between the on indicator 70 and the fixed indicator 74 of the sleeve and fixed insulative body section 12, indicates appropriately the condition of the switch, that is, the creation of an electrical circuit between conductive elements 68 and flexible contacts 42 and 44 coupled to prong sections 38 and 40 respectively. Rotation of the sleeve clockwise from the position shown in FIGS. 1 and 3 to the position shown in FIG. 4 moves the off indicator on the sleeve as at 72 to a position of alignment with the fixed indicator 74 of section 12 and a ready indication of switch disconnect position insofar as the contacts 42 and 44 are concerned.

The device can be employed in conjunction with a two prong plug for opening selectively either the hot or ground wire, circuits may be broken in both prongs to insure minimization of electrical shock. Instead of employing a sleeve 16 to move the plate 60 to a position such that the conductive element 68 embedded within plate 60 is either interposed between the contacts 42 and 44 or an insulative portion of that plate. The sleeve can be replaced by a handle which extends radially outward of the two part body and the handle may be employed to either rotate the plate such as plate 60 on a pivot point internally of the switch body, or slide the plate from side to side.

While the invention has been particularly shown and described with reference to a preferred embodiment thereof, it will be understood by those skilled in the art that various changes in form and details may be made therein without departing from the spirit and scope of the invention.

What is claimed is:

1. In an electrical connector plug including a body of electrically insulative material, and a plurality of metal conductive prongs projecting axially through said body in circumferentially spaced positions, and wires electrically connected respectively to said prongs, the improvements wherein:

at least one of said prongs comprises first and second axially spaced, aligned sections, a plate formed of electrically insulative material is positioned within said body and selectively movable between two positions, one of which insures completion of an electrical circuit between said prong sections and the other wherein a portion of said insulated material is interposed between said prong sections, said body is cylindrical in form, and a sleeve is mounted concentrically on said body for rotation about a common axis and said plate comprises a radial projection on the inner periphery of said sleeve, which projects inwardly within said body and is interposed between said prong sections upon rotation of said sleeve, and said body comprises abutting cylindrical sections, a recess is provided in the abutting end of at least one of said cylindrical sections, said first and second axially spaced aligned prong sections have their axes intersecting said recess, opposed flexible contacts are carried by respective prong sections within said recess, and said radially projecting plate of said rotatable sleeve extends into said axis and is interposed between said flexible contacts.

2. The electrical connector plug as claimed in claim 1, wherein: said plate includes a conductive portion for effecting electrical circuit completion between said flexible contacts with said cylinder rotated to one position, and an adjacent electrically insulative portion which is interposed between said contacts when said sleeve is rotated to a second position.

3. A male electrical connector plug comprising, in combination; abutting cylindrical body sections formed of an electrically insulative material, a plurality of opposed arcuate recesses formed within the abutting ends of said body sections, at least one electrically conductive male prong projecting through both body sections, circumferentially spaced first and second, axially spaced, axially aligned prong sections carried by respective body sections and having ends terminating respectively at said arcuate recesses, flexible contacts mounted to respective prong sections within said recess and contacting each other when in relaxed condition, a sleeve concentrically positioned on said body sections, an arcuate slot within at least one of said body sections and opening into said recess, and an integral plate of electrically insulative material projecting radially inward of said sleeve, through said arcuate slot with its radially inner end interposed between said flexible contacts to separate the same, said plate including circumferentially spaced conductive and insulative portions, and said sleeve being rotatable between positions in which either said conductive or said insulative portion is selectively interposed between said switch contacts.

* * * * *